US006229764B1

(12) United States Patent
Tongue

(10) Patent No.: US 6,229,764 B1
(45) Date of Patent: May 8, 2001

(54) IMPACT RESPONSIVE TRAINING DEVICE

(76) Inventor: Steven R. Tongue, Top Flat, 369 Liverpool Road, Islington London N1 1NL (GB)

( * ) Notice: Subject to any disclaimer, the term of this patent is extended or adjusted under 35 U.S.C. 154(b) by 0 days.

(21) Appl. No.: 09/086,448

(22) Filed: May 28, 1998

(51) Int. Cl.[7] ..... G04F 8/00; G04F 10/00; G08B 23/00; A63B 71/06

(52) U.S. Cl. ..... 368/110; 368/113; 340/323 R; 377/5; 377/20

(58) Field of Search ..... 368/107–113, 10, 368/11; 377/5, 15, 20, 24, 24.2; 340/323 R; 200/85 R, 52 R; 248/685–688; 482/8, 84

(56) References Cited

U.S. PATENT DOCUMENTS

| | | | | |
|---|---|---|---|---|
| 2,501,549 | * | 3/1950 | Swenson . | |
| 4,518,266 | * | 5/1985 | Pauley | 368/10 |
| 4,700,369 | * | 10/1987 | Siegal et al. | 377/24 |
| 4,932,045 | * | 6/1990 | Kasoff et al. | 377/24.2 |
| 5,242,355 | * | 9/1993 | Costa | 482/141 |
| 5,343,445 | * | 8/1994 | Cherdaic | 368/10 |
| 5,503,101 | * | 4/1996 | Mullinix | 116/67 R |
| 5,732,928 | * | 3/1998 | Chang | 248/688 |

* cited by examiner

*Primary Examiner*—Vit Miska

(57) ABSTRACT

An athletic training device including a housing. Also included is light or speaker mounted on the housing for providing an indication upon the actuation thereof. At least one impact sensor is mounted on the housing for actuating the indication means upon being struck by a user.

12 Claims, 2 Drawing Sheets

IMPACT RESPONSIVE TRAINING DEVICE

BACKGROUND OF THE INVENTION

1. Field of the Invention

The present invention relates to training devices and more particularly pertains to a new impact responsive training device for tracking and monitoring an exerciser.

2. Description of the Prior Art

The use of training devices is known in the prior art. More specifically, training devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art training devices include U.S. Pat. No. 5,285,428; U.S. Pat. No. 4,632,570; U.S. Pat. No. 4,530,105; U.S. Pat. No. 3,230,325; U.S. Pat. No. 1,245,419; and U.S. Pat. No. 4,993,004.

In these respects, the impact responsive training device according to the present invention substantially departs from the conventional concepts and designs of the prior art, and in so doing provides an apparatus primarily developed for the purpose of tracking and monitoring an exerciser.

SUMMARY OF THE INVENTION

In view of the foregoing disadvantages inherent in the known types of training devices now present in the prior art, the present invention provides a new impact responsive training device construction wherein the same can be utilized for tracking and monitoring an exerciser.

The general purpose of the present invention, which will be described subsequently in greater detail, is to provide a new impact responsive training device apparatus and method which has many of the advantages of the training devices mentioned heretofore and many novel features that result in a new impact responsive training device which is not anticipated, rendered obvious, suggested, or even implied by any of the prior art training devices, either alone or in any combination thereof.

To attain this, the present invention generally comprises a housing having a planar circular bottom face and a frusto-semispherical top face coupled to the bottom face for defining an interior space. As shown in FIG. 1, the top face has a circular planar portion formed on an apex thereof. A transparent semisphcrical lid is pivotally mounted thereon for defining a compartment when closed. For mounting the housing on a smooth recipient surface, a plurality of suction cups are provided. As shown in FIG. 4, each suction cup has a threaded post integrally coupled to its top face. The threaded post of each suction cup is adapted for releasably coupling within one of a plurality of threaded bores formed in the bottom face of the housing. Also included is a plurality of spikes each having an inboard end pivotally coupled within one of a plurality of radially extending rectangular recesses. See FIG. 5. Such rectangular recesses are formed in the bottom face of the housing. In use, each spike is adapted for pivoting between a collapsed orientation within the corresponding recess and a deployed orientation extending downwardly therefrom. It should be noted that the spikes each are pivotally coupled within an outboard end of the corresponding recess. A plurality of speakers are mounted on the top face of the housing about the circular planar portion. The speakers are adapted to generate a brief sound upon being actuated. Associated therewith is at least one light mounted on the top face of the housing for illuminating upon actuation. FIG. 1 shows a digital display mounted on the circular planar portion with unillustrated control means. Such control means has a first mode of operation for discretely incrementing a number sequence on the display. Such number sequence is incremented only upon being actuated. The control means further has a second mode of operation for continuously incrementing a clock upon a first actuation thereof. This incrementing of the clock is further ceased upon a second actuation thereof, thereby affording a stop watch type function. The control means further has a third mode of operation for continuously decrementing a timer upon the actuation thereof. Finally, a plurality of impact sensors are provided including a plurality of spherical impact sensors each mounted to an inner surface of the top face of the housing. An annular impact sensor is mounted on the top face of the housing about the circular planar portion. The annular impact sensor is adapted for being situated between the housing and a lower peripheral edge of the lid when closed. In use, the impact sensors are connected to the speakers, light and the control means of the digital display for actuating the same upon being struck by a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new impact responsive training device apparatus and method which has many of the advantages of the training devices mentioned heretofore and many novel features that result in a new impact responsive training device which is not anticipated, rendered obvious, suggested, or even implied by any of the prior art training devices, either alone or in any combination thereof.

It is another object of the present invention to provide a view impact responsive training device which may be easily and efficiently manufactured and marketed.

It is a further object of the present invention to provide a new impact responsive training device which is of a durable and reliable construction.

An even further object of the present invention is to provide a new impact responsive training device which is susceptible of a low cost of manufacture with regard to both materials and labor, and which accordingly is then susceptible of low prices of sale to the consuming public, thereby making such impact responsive training device economically available to the buying public.

Still yet another object of the present invention is to provide a new impact responsive training device which provides in the apparatuses and methods of the prior art some of the advantages thereof, while simultaneously overcoming some of the disadvantages normally associated therewith.

Still another object of the present invention is to provide a new impact responsive training device for tracking and monitoring an exerciser.

Even still another object of the present invention is to provide a new impact responsive training device that includes a housing. Also included is light or speaker mounted on the housing for providing an indication upon the actuation thereof. At least one impact sensor is mounted on the housing for actuating the indication means upon being struck by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
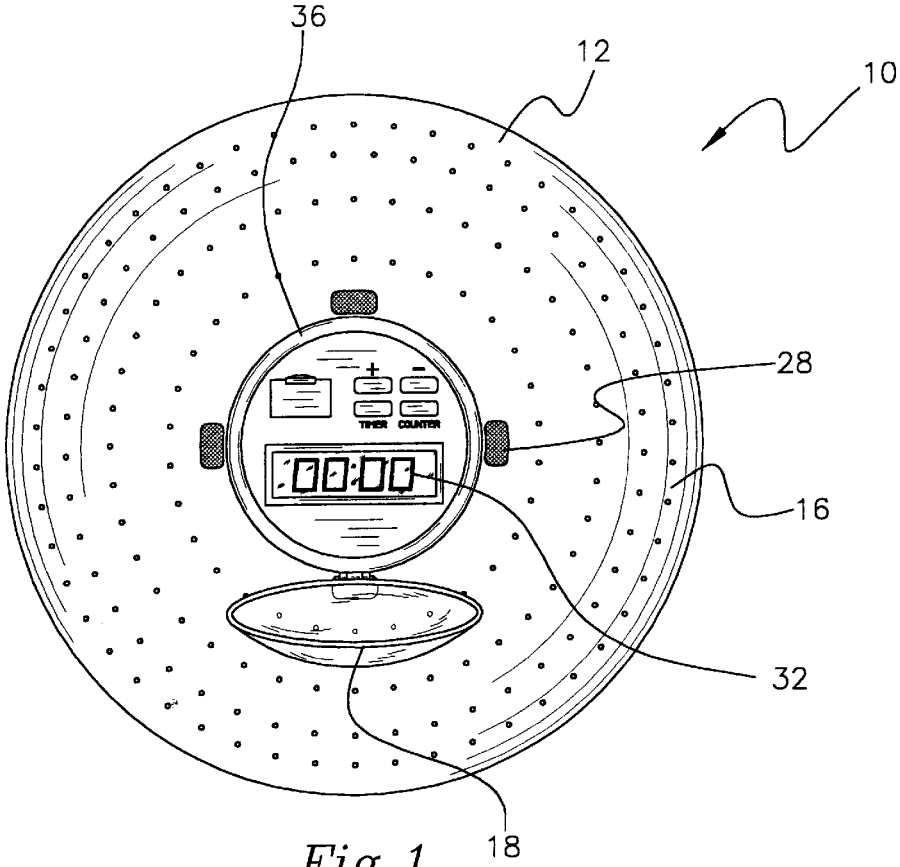
FIG. 1 is a top view of a new impact responsive training device according to the present invention.
Figure 2:
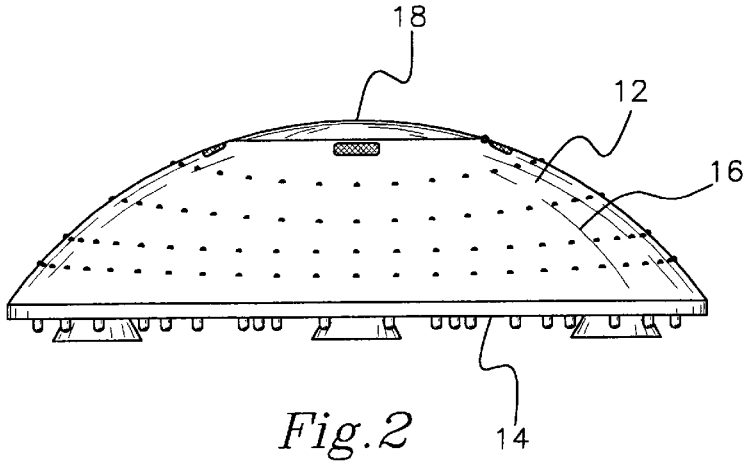
FIG. 2 is a side view of the present invention.

With reference now to the drawings, and in particular to FIGS. 1 through 5 thereof, a new impact responsive training device embodying the principles and concepts of the present invention and generally designated by the reference numeral 10 will be described.

The present invention, designated as numeral 10, includes a pimpled housing 12 having a planar circular bottom face 14 and a frusto-semispherical top face 16 coupled to the bottom face for defining an interior space. As shown in FIG. 1, the top face has a circular planar portion formed on an apex thereof. A transparent semispherical lid 18 is pivotally mounted thereon for defining a compartment when closed. The housing of the present invention thus resembles a conventional "UFO".

Figure 4:
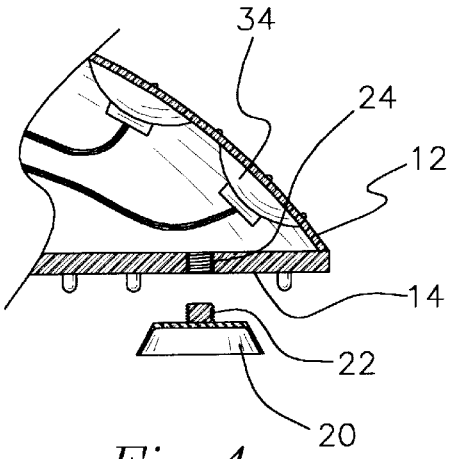
FIG. 4 is a side cross-sectional view of one of the suction cups taken along line 4—4 shown in FIG. 3.
Figure 5:
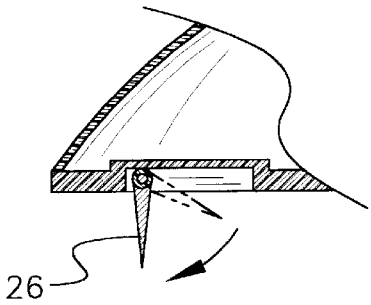
FIG. 5 is a side cross-sectional view of one of the spikes taken along line 5—5 shown in FIG. 3.

For mounting the housing on a smooth recipient surface such as a gym floor, a plurality of suction cups 20 are provided. As shown in FIG. 4, each suction cup has a threaded post 22 integrally coupled to its top face. The threaded post of each suction cup is adapted for releasably coupling within one of a plurality of threaded bores 24 formed in the bottom face of the housing.

Figure 3:
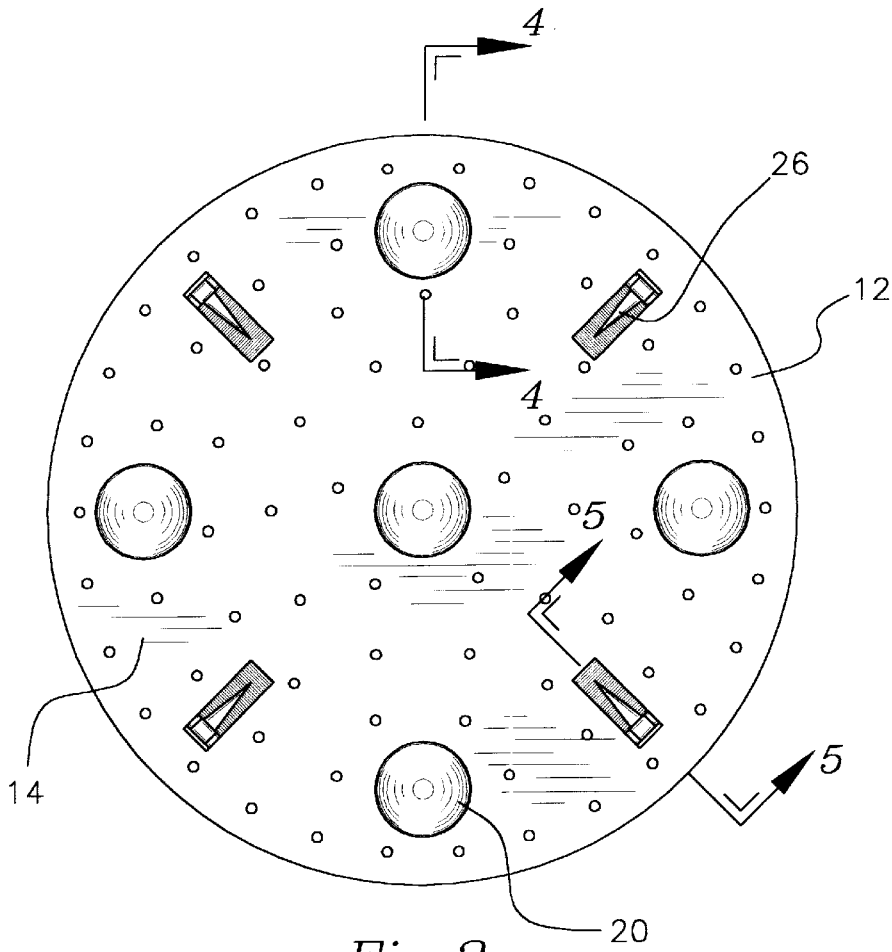
FIG. 3 is a bottom view of the present invention.

Also included is a plurality of spikes 26 each having an inboard end pivotally coupled within one of a plurality of radially extending rectangular recesses. See FIG. 5. Such rectangular recesses are formed in the bottom face of the housing. In use, each spike is adapted for pivoting between a collapsed orientation within the corresponding recess and a deployed orientation extending downwardly therefrom. It should be noted that the spikes are each pivotally coupled within an outboard end of the corresponding recess. As shown in FIG. 3, a suction cup is situated on a central extent of the housing. Further, the spikes and suction cups are mounted along a periphery of the housing in an alternating fashion.

A plurality of speakers 28 are mounted on the top face of the housing about the circular planar portion. The speakers are adapted to generate a brief sound upon being actuated. Associated therewith is at least one unillustrated light mounted on the circular planar portion of the housing for illuminating upon actuation.

FIG. 1 shows a digital display 32 mounted on the circular planar portion with unillustrated control means. Such control means has multiple modes which may be chosen by way of a mode selection switch or the like. It should be understood that the control means may be deactuated or used to control the digital display as a conventional clock when desired.

The control means has a first mode of operation for discretely incrementing a number sequence on the display. Such number sequence is incremented only upon the control means being actuated. As will soon become apparent, this mode of operation may be used to count laps of a runner. The control means further has a second mode of operation for continuously incrementing a clock upon a first actuation thereof. This incrementing of the clock is further ceased upon a second actuation of the control means, thereby affording a stopwatch-type function. The control means further has a third mode of operation for continuously decrementing a timer upon the actuation thereof. The time at which the tinier starts decrementing may be selected by way of a "+" and "−" switch.

Finally, a plurality of impact sensors are provided including numerous spherical impact sensors 34 each mounted to an inner surface of the top face of the housing. An annular impact sensor 36 is mounted on the top face of the housing about the circular planar portion. The annular impact sensor is adapted for being situated between the housing and a lower peripheral edge of the lid when closed. In use, the impact sensors are connected to the speakers, light and the control means of the digital display for actuating the same upon being struck by a user. It should be noted that the user may strike either a portion of the top face surrounding the lid or in the alternative, the lid itself may be impacted. To accomplish their attended function, the impact sensors basically comprise a sensitive push button, mercury switch or the like.

In use, the present invention is used to ensure that a runner or the like passes certain check points while exercising. For example, the housings may be situated around a track such that a runner may strike the same to indicate that he or she has passed a certain point. Such indication is provided by the light and speakers. The digital display may further be used to count laps and/or track time while exercising.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An athletic training device comprising, in combination:

a housing including a planar circular bottom face and a frusto-semispherical top face coupled to the bottom face for defining an interior space, the top face having a circular planar portion formed on an apex thereof with a transparent semispherical lid pivotally mounted thereon for defining a compartment when closed;

a plurality of suction cups each having a threaded post integrally coupled to a top face thereof for releasably coupling within one of a plurality of threaded bores formed in the bottom face of the housing for securing the housing to a smooth recipient surface;

a plurality of spikes each having an inboard end pivotally coupled within one of a plurality of radially extending rectangular recesses formed in the bottom face of the housing for pivoting between a collapsed orientation within the corresponding recess and a deployed orientation extending downwardly therefrom, wherein the spikes each are pivotally coupled within an outboard end of the corresponding recess;

a plurality of speakers mounted on the top face of the housing about the circular planar portion thereof, the speakers adapted to generate a brief sound upon the actuation thereof;

at least one light mounted on the top face of the housing for illuminating upon the actuation thereof;

a digital display mounted on the circular planar portion with control means having a first mode of operation for discretely incrementing a number sequence on the display wherein the number sequence is incremented only upon being actuated, a second mode of operation for continuously incrementing a clock upon a first actuation thereof and further ceasing such incrementing of the clock upon a second actuation thereof, and a third mode of operation for continuously decrementing a timer upon the actuation thereof;

a plurality of impact sensors for detecting impacts at any location on the top face and up of the housing, the plurality of impact sensors including a plurality of first impact sensors each mounted to an inner surface of the top face of the housing and being positioned along the inner surface so that striking of any location on the top face of the housing is detected by one of the first impact sensors, and a second impact sensor mounted on the top face of the housing, the second impact sensor having an annular shape surrounding the circular portion and being situated between the housing and a lower peripheral edge of the lid when closed so that sriking the lid actuates the second impact sensor, the impact sensors being connected to the speakers, light and the control means of the digital display for actuating the same upon being struck by a user; and wherein the top face of the housing has a plurality of nubs for facilitating actuation of the impact sensors by resisting slippage of an impacting body part of a user on the housing.

2. An athletic training device comprising:

a housing;

indication means mounted on the housing for providing an indication upon the actuation thereof;

a plurality of impact sensors for detecting at any location on a top face of the housing, the plurality of impact sensors including a plurality of first impact sensors each mounted to an inner surface of the top face of the housing and being positioned along the inner surface so that striking of any location on the top face of the housing is detected by one of the first impact sensors, and a second impact sensor mounted on the top face of the housing, the second impact sensor having an annular shape surrounding a circular portion and being situated between the housing and a lower peripheral edge of a lid when closed so that striking a lid actuates the second impact sensor, the impact sensors being connected to speakers, a light and a control means of a digital display for actuating the same upon being struck by a user.

3. An athletic training device as set forth in claim 2 wherein the housing has a planar bottom face.

4. An athletic training device as set forth in claim 2 wherein the housing has mounting means for securing the same to a recipient surface.

5. An athletic training device as set forth in claim 4 wherein the mounting means includes at least one suction cup.

6. An athletic training device as set forth in claim 4 wherein the mounting means includes at least one spike.

7. An athletic training device as set forth in claim 6 wherein the spike is retractable.

8. An athletic training device as set forth in claim 2 wherein the digital display is mounted on the housing with the control means for discretely incrementing a number sequence on the digital display wherein the number sequence is incremented only upon the control means being actuated by the impact sensor.

9. An athletic training device as set forth in claim 2 wherein the digital display is mounted on the housing with the control means for continuously incrementing a clock upon a first actuation thereof and further ceasing such incrementing of the clock upon a second actuation thereof by the impact sensor.

10. An athletic training device as set forth in claim 2 wherein the digital display is mounted on the housing with the control means for continuously decrementing a timer upon the actuation thereof by the impact sensor.

11. An athletic training device as set forth in claim 2 further comprising a top face of the housing having a plurality of nubs for facilitating actuation of the impact sensors by resisting slippage of an impacting body part of a user on the housing.

12. An athletic training device comprising:

a housing including a circular bottom face and a frusto-semispherical top face coupled to the bottom face for defining an interior space, the top face having a circular portion formed on an apex thereof with a transparent semispherical lid pivotally mounted thereon for defining a compartment when closed;

a plurality of suction cups each being releasably coupled to the bottom face of the housing for securing the housing to a smooth recipient surface;

a plurality of spikes each having an inboard end pivotally coupled to the bottom face of the housing for pivoting between a collapsed orientation and a deployed orientation extending substantially perpendicular to the bottom face for spiking into a recipient surface;

a plurality of speakers mounted on the top face of the housing about the circular portion thereof, the speakers adapted to generate a sound upon the actuation thereof;

at least one light mounted on the top face of the housing for illuminating upon the actuation thereof;

a digital display mounted on the circular portion with control means having a first mode of operation for incrementing a number sequence on the display, wherein the number sequence is incremented only upon being actuated, a second mode of operation for continuously incrementing a clock upon a first actuation thereof and further ceasing such incrementing of the clock upon a second actuation thereof, and a third mode of operation for continuously decrementing a timer upon the actuation thereof; and a plurality of impact sensors for detecting at any location on the top face and up of the housing, the plurality of impact sensors including a plurality of first impact sensors each mounted to an inner surface of the top face of the housing and being positioned along the inner surface so that striking of any location on the top face of the housing is detected by one of the first impact sensors, and a second impact sensor mounted on the top face of the housing, the second impact sensor having an annular shape surrounding the circular portion and being situated between the housing and a lower peripheral edge of the lid when closed so that striking the lid actuates the second impact sensor, the impact sensors being connected to the speakers, light and the control means of the digital display for actuating the same upon being struck by a user.

* * * * *